United States Patent [19]

Berney

[11] 4,259,736

[45] Mar. 31, 1981

[54] ELECTRONIC TIMEPIECE

[75] Inventor: Jean-Claude Berney, Epalinges, Switzerland

[73] Assignee: Jean-Claude Berney SA, Epalinges, Switzerland

[21] Appl. No.: 917,535

[22] Filed: Jun. 21, 1978

[30] Foreign Application Priority Data

Jul. 18, 1977 [CH] Switzerland ..... 8851/77

[51] Int. Cl.[3] ..... G04B 23/02; G04C 21/00; G04C 23/00; G04C 21/16

[52] U.S. Cl. ..... 368/62; 368/72; 368/243; 368/250; 368/184

[58] Field of Search ..... 58/23 R, 5, 85.5, 152 B, 58/16, 16 D, 16.5, 19 B, 19 A, 19 R, 34, 33, 35 R, 50 R, 38 R, 23 A, 58, 4 R

[56] References Cited

U.S. PATENT DOCUMENTS

| | | | |
|---|---|---|---|
| 3,802,622 | 4/1974 | Nishimura et al. | 235/151.11 |
| 3,934,185 | 1/1976 | Schoonover et al. | 318/565 |
| 3,943,696 | 3/1976 | Portmann | 58/23 R |
| 3,967,442 | 7/1976 | Berney | 58/23 R |
| 3,998,043 | 12/1976 | Tamaru et al. | 58/23 R |

*Primary Examiner*—S. J. Witkowski
*Assistant Examiner*—John B. Conklin
*Attorney, Agent, or Firm*—Wender, Murase & White

[57] ABSTRACT

The electronic timepiece comprises circuits within an integrated circuit for effecting at least one auxiliary function associated with information supplied to their inputs and, programming circuits for programming and memorizing the said information. A system applied to the timepiece makes it possible to consult and reprogram manually the memory from outside the timepiece, as well as memorizing the state of this memory in the absence of feed voltage, for as long as necessary.

11 Claims, 6 Drawing Figures

ELECTRONIC TIMEPIECE

The present invention relates to an electronic timepiece comprising an electric feed source, a resonator, a step-by-step type motor driving the time display by means of a gear wheel mechanism and control means and time setting means, and an integrated circuit comprising an oscillator, a frequency divider, circuits for affecting at least one auxiliary function associated with information present at their inputs, programming circuits for programming and memorising the said information, a circuit feeding the motor sending driving pulses, at least one counting circuit of these pulses and a time setting control circuit.

The simplest analog quartz watches comprise: an integrated circuit including an oscillator, a frequency divider, a circuit feeding the motor and a control and time setting circuit; a quartz resonator; an electric feed source; a motor generally of the step-by-step type driving the time display mechanism; and time setting means generally comprising a contact actuated by the shaft for controlling the zero setting of the divider and the stopping of the motor.

Some more sophisticated watches also comprise a second contact actuated by the time setting shaft or by a separate push button enabling some extra functions of the circuit to be controlled.

One of these functions consists of adding or suppressing pulses to the motor for effecting fine time setting.

Another known function consists in rapid time setting. The circuit then comprises two counters-by-60 and means for keeping these two counters in a condition of equality. The first counter is previously synchronised with the seconds hand. The other counter serves as a reference. When the push button is actuated, the reference counter is set to 0, and means provided return the minutes counter to equality with the reference counter by adding or suppressing pulses to the motor. By pressing the push button at the time signal, it is then possible to correct automatically differences of plus or minus 30 seconds.

Some watches comprise a third contact connected to the mechanism making it possible to detect a specific angular position thereof, for example, the position 0 of the seconds hand. This contact makes it possible automatically to synchronise a minutes counter in the above mentioned system. It also makes it possible to detect and correct counter errors of the motor due to shock or any other cause.

Again, some watches comprise a system for detecting and displaying insufficient voltage from the electric feed source.

Yet again, some watches comprise circuits within the integrated circuit for effecting an auxiliary function associated with information supplied to their inputs, for example, a system for programming an alarm time or an inhibition system permitting the use of a quartz resonator, the frequency of which is different from the theoretically necessary frequency. These systems comprise a circuit for adjusting the frequency of the output signals of the divider which act, as the case may be, preselecting the rate of division of the divider, or adding or suppressing pulses to the input of one or more stages of the divider at specific intervals of time. This adjustment circuit may be programmed by terminals of the integrated circuit reserved for this purpose, or by way of internal memories of ROM or RAM type.

Memories of ROM type can be programmed only once, and therefore can not be adapted to subsequent variations in the frequency of the quartz, such as ageing.

Memories of RAM type, however, can be re-programmed, but programming thereof requires relatively complicated apparatus, for it is not possible in known systems to know the state of the memory and to re-programme it consequently by simple means.

Memories of RAM type, on the other hand, have the defect of losing their state when the feed voltage disappears. One known system consists in using a buffer accumulator. Unfortunately, miniature accumulators known at present are not reliable and, in any case, the information can only be stored for a limited duration.

SUMMARY OF THE INVENTION

The object of the present invention is a system that can be applied to a watch having auxiliary function circuits, which system makes it possible to consult and reprogram manually the memory from outside the watch, as well as memorising the state of this memory in the absence of feed voltage, for as long as necessary.

According to the present invention there is provided an electronic timepiece comprising an electric feed source, a resonator, a step-by-step type motor driving the time display by means of a gear-wheel mechanism and control and time setting means, and an integrated circuit comprising in particular an oscillator, a frequency divider, circuits to effect at least one auxiliary function relative to information present at their inputs, programming circuits for programming and memorising the said information, a feed circuit of the motor for delivering driving pulses, at least one circuit for counting these driving pulses and a control and time setting circuit, wherein the control circuit, connected on the one hand, to the circuits for programming, feeding the motor and counting the driving pulses and, on the other hand, to contacts actuated by the control and time setting means and to detection members within or external of the integrated circuit, is arranged in such manner that when certain pre-determined combinations of signals appear on the terminals of the said contacts and detection members, it acts according to the combination of these signals, either on the programming circuit by means of the said feeding and counting circuits so as to programme the said information as a function of the number of pulses received by the motor between two specific positions of at least one of the time display hands, or on the feed circuit of the motor by means of the said programming and counting circuits so as to block the motor at least momentarily when the said hand is in one or other of the positions corresponding to the information.

The present invention will be described further, by way of example, with reference to the accompanying drawings.

DESCRIPTION OF THE PREFERRED EMBODIMENTS

Figure 1:
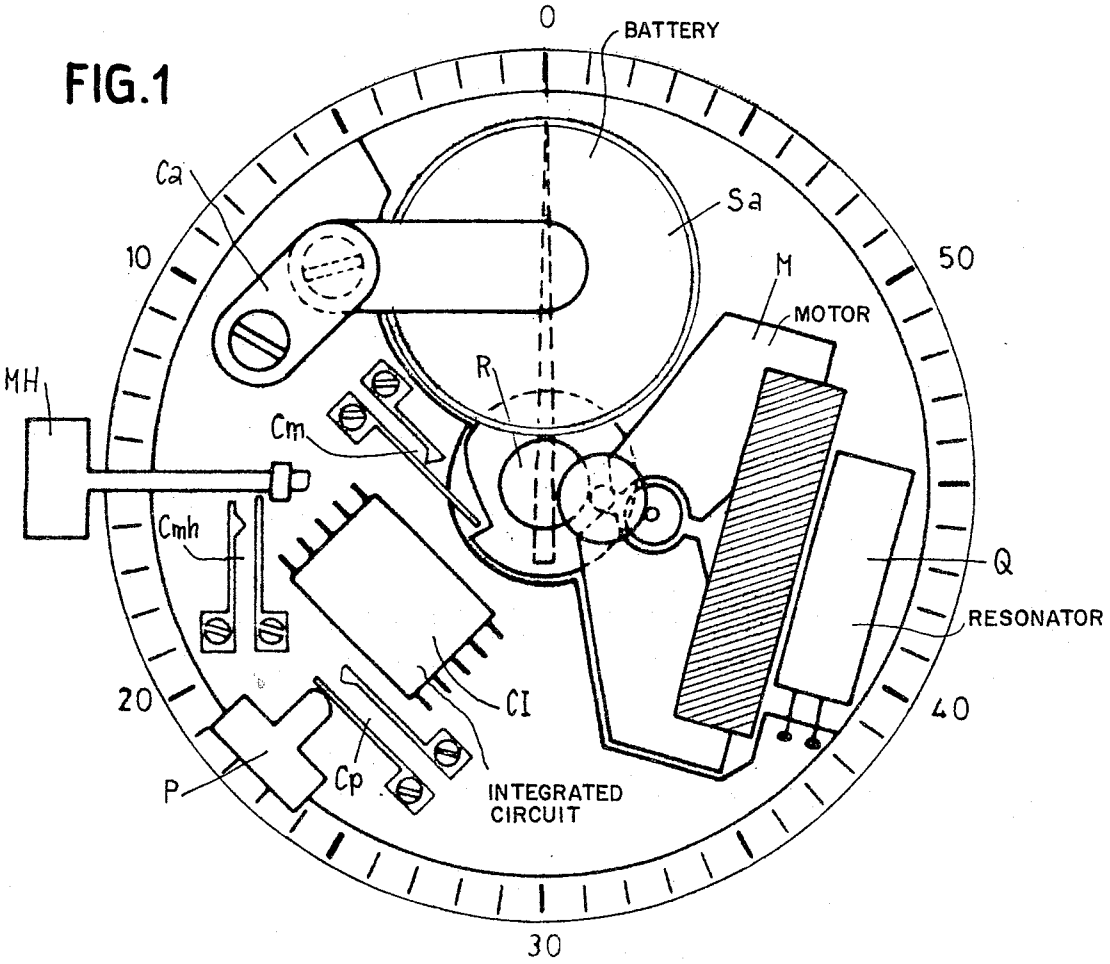
FIG. 1 is a schematic view of an embodiment of a timepiece movement according to the present invention.

FIG. 1 shows schematically a timepiece movement according to the invention. This watch comprises an encapsulated resonator Q, an electric feed source Sa, a step-by-step type motor M, which is actuated by a coil and drives the gear-train R and, by way of this, a time display of which only the seconds hand is shown. The watch also comprises control means and time setting means including a time setting shaft MH for actuating a contact Cmh, and a push button P for actuating the contact Cp, as well as an integrated circuit CI connected to the other components by a printed or thick film connecting circuit. The time setting shaft MH has at least one specific axial position in which it engages mechanical means for setting the time or the date (not shown). This watch also comprises, in certain cases, a minute contact Cm actuated by a cam driven by the geartrain R, which contact Cm closes once per minute when the seconds hand arrives at the position 0, and a contact brace Ca connecting a pole of the electric feed source to a point of the printed circuit and arranged so that it has to be positioned after the battery clip and withdrawn before the battery clip. At least some of these components are used in the circuits of the following figures.

Figure 2:
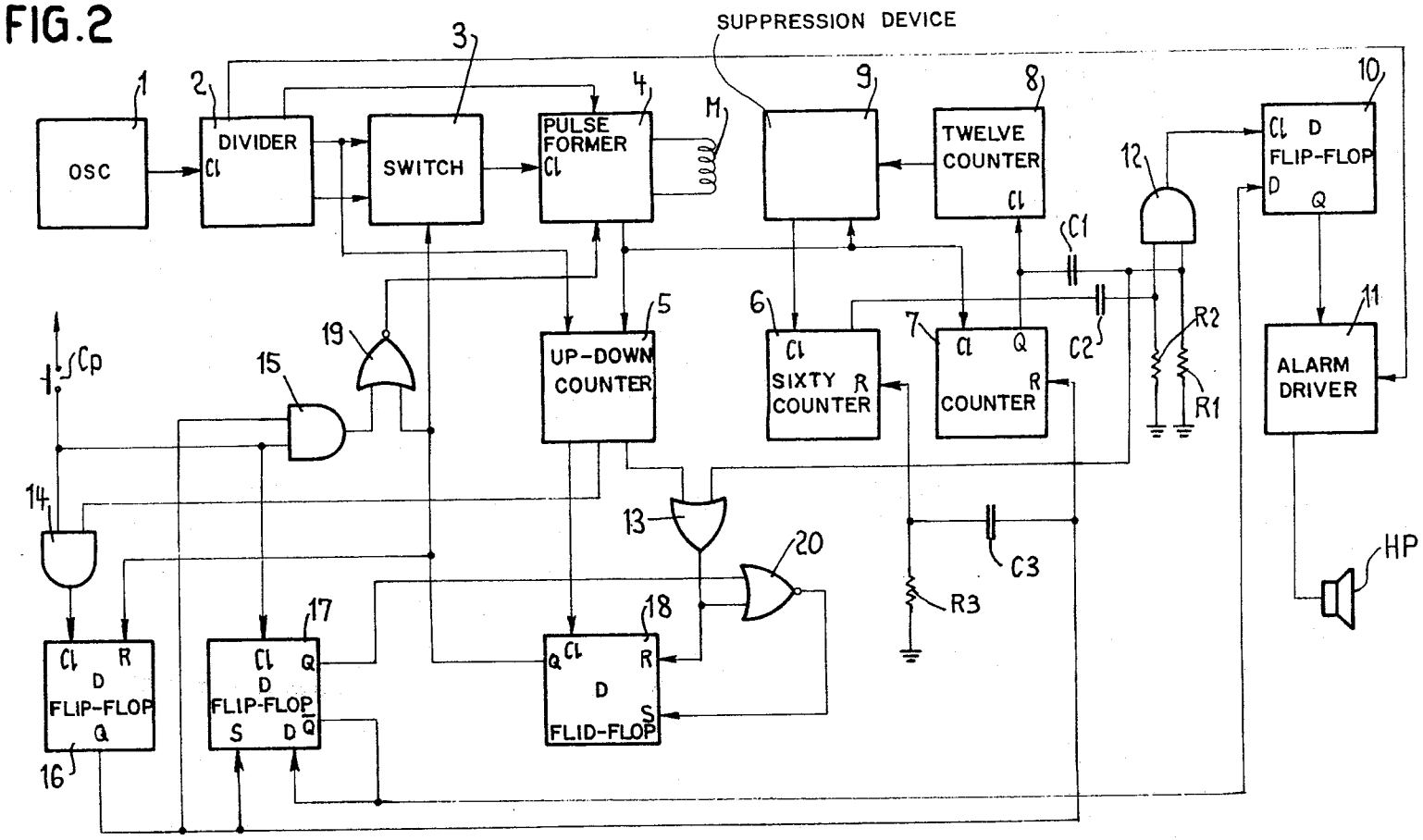
FIG. 2 is a block diagram of an electrical circuit used in the timepiece of FIG. 1 according to the present invention, making it possible to program an alarm time.

The diagram shown in FIG. 2 represents a watch circuit according to the invention making it possible to programme an alarm time. This feature is in fact one of the most interesting to a user. Obviously, during the setting of the alarm, the time must be memorized and correctly restored at the end of the setting operation so that the proper time display is maintained. The described arrangement does not include detection means for automatically establishing the relation between the time displayed and the content of the time counters. This relation must therefore be established during the programming process. It is also important that the user should be able to display the alarm time he has programmed at any moment.

The circuit shown in FIG. 2 comprises a quartz oscillator 1 connected to the input of a divider 2. A first output of this divider 2 is connected to a first input of a switch 3 and to the up clock input of an up-down-counter 5, which divides by 64. A second output of the divider 2 is connected to a second input of the switch 3, the output of which is applied to a first input of the driving pulse former 4. The divider 2 also has two outer outputs, one is applied to a first input of an alarm circuit 11, and the other is connected to a second input of the former 4. Two outputs of this former 4 feed the coil of the motor M, whilst its third output is connected to the down clock input of the counter 5, to a first input of a suppression circuit 9 and to the clock input of a counter 7, which divides by 60. The output of the counter 7 is connected via a capacitor C1 to the first input of an AND gate 12 and to the first input of an OR gate 13, these inputs being connected to ground via a resistor R1. This same output of the counter 7 is also applied to the input of a twelve counter 8, the output of which is connected to a second input of the suppression circuit 9. The output of the circuit 9 is connected to the "clock" input of the sixty counter 6, the output of which is connected via a capacitor C2 to the second input of the AND gate 12 and to ground via a resistor R2. The output of the gate 12 is applied to the "clock" input of a D flip-flop 10, the output of which controls a second input of the alarm circuit 11. The output of the alarm circuit 11 is connected to any sound emission device HP, shown in the figure by a loudspeaker.

The contact $C_p$, actuated by the push button P, is connected to the first inputs of AND gates 14 and 15 and also to the "clock" input of a D flip-flop 17 functioning as a divide by 2 circuit. The output of the counter 5 which corresponds to the state 3 is applied to the second input of the gate 14, the output of which is connected to the "clock" input of a D flip-flop 16. The Q output of this FF16 is connected to the second input of the gate 15, the output of which is applied to the first input of the NOR gate 19. This Q output of FF16 is also connected to the set input of FF17, to the reset input of the counter 7, then to the reset input of the counter 6, via a capacitor $C_3$, this latter input being connected to earth via a resistor R3. The output of the counter 5 which corresponds to the count state 0 is applied to the second input of the gate 13, the output of which is connected to the reset input of the D flip-flop 18, and to the first input of a NOR gate 20, the output of which is connected to the set input of FF18. The output of the counter 5 which corresponds to count state 63 (maximum capacity) is connected to the clock input of FF18, the Q output of which is applied to the reset input of FF16, to the second input of the gate 19, and to the control input of the switch 3. The output of the gate 19 is connected to the enable input of the former 4. The Q output of FF17 is connected to the second input of the gate 20, whilst its Q output is connected to its input D and to the enable input of FF10.

Let us now examine the operation of the above detailed circuit according to the phases determined by successive pressures on the button P which controls the closing of contact Cp.

The oscillator 1 delivers a signal of specific frequency to the divider 2. Two signals of this divider 2, one being of frequency 1 Hz, the other of frequency 32 Hz, which correspond respectively to normal advance and rapid advance of the motor M, are applied to the switch 3 which selects one of them for its output according to its state. The 1 Hz signal is also applied to the "up clock" input of the counter 5. The former 4 feeds the motor coil M with pulses of alternating polarity, the duration of which is fixed by a signal of higher frequency, for example 64 Hz, furnished by a third output of the divider 2. The output of the former 4 applied to the "down clock" input of the counter 5, delivers pulses of the same frequency as those supplied to the motor M. Assuming the counter 5 is at 0, its output which corresponds to this count or state is at 1 which effects the "reset" of FF18, the output Q thereof passing to 0, so that the switch 3 is on normal advance of 1 Hz. The contact Cp being open, the output of the gate 15 is at 0 and the output of gate 19 at 1. This blocks the former 4, stopping the motor M as well as the hands of the timepiece. When the next pulse of 1 Hz appears at the "up clock" input of the counter 5, the latter passes to state 1, so that its output which corresponds to the state 0 passes to 0. The output of gate 13 is at 0 and the output of gate 20 is at 1, as is the "set" input of FF18 so that the switch 3 is on rapid advance of 32 Hz and the former 4 is unblocked. The first pulse of the 32 Hz signal received by the former 4 advances the motor M by one step, as well as the seconds hand of the timepiece. Simultaneously the counter 5 receives a pulse at its "down clock" input which returns it to its state 0. The Q output of FF18 then returns to 0, the switch 3 passes to normal advance of 1 Hz, and the former 4 is blocked. It is necessary to wait for the next pulse of the 1 Hz signal to unblock the former 4 and again permit the advance of the motor M by one step. To sum up, the watch acts normally, with the seconds hand advancing one step each second, as long as the alarm device is not in use.

Let us now examine the operation and display of the already entered and stored alarm time.

An initial brief pressure on the button P which closes the contact Cp switches over the FF17. The Q output of FF17, hence the D input of FF10, passes to 0. FF10 remains unchanged, but it is enabled and can change state at the appearance of a pulse on its clock input at the moment of the alarm time, and therefore control the circuit 11 which feeds the sound device HP. The alarm is not set. The Q output of FF17 is at 1, thus imposing the state 0 on the output of the gate 20 and hence on the set input of FF18. When the counter 5 receives a pulse on its up clock input, it passes to 1, and the reset inut of FF18 passes to 0; but FF18 does not change state, since its set input is already at 0, and consequently its Q output remains at 0. The switch 3 is at normal advance, but the former 4 is blocked, hence the motor M is at stop, as are the hands of the timepiece. The counter 5 receives only 1 Hz pulses at its up clock input. When the counter 5 reaches its maximum capacity and passes to state 63, it gives a pulse to the clock input of FF18 which changes the output 0 thereof to 1, causing the rapid advance of the motor M and of the hands of the timepiece, which makes up for some of the accumulated delay. The counters 7 and 5 now simultaneously receive the equivalent of the driving pulses. These pulses are counted up by counter 7 from a state determined by the alarm time and the time at which P has been actuated, and counted down by counter 5 from the state 63. When counter 7 passes from 59 to 0, which necessarily takes place before the counter 5 returns to 0, since the capacity of the latter is greater, it effects the resetting of FF18 through the gate 13. The motor M stops again, and has therefore made up for only part of the delay. We shall see hereinafter that when the counter 7 is at state 0, the seconds hand is in a position which, relative to the hour scale, corresponds to the alarm time (as explained below in programming of the alarm time). The user can therefore check this time which is indicated by the position of the seconds hand read on the hour scale. How, only the counter 5 receives 1 Hz pulses at its up clock input, and it counts up to the state 63 for a total number of pulses equal to the overtaken sector, and then delivers a pulse to the clock input of FF18, the Q output of which passes to 1, thus retaining the motor M to rapid operation. The counters 7 and 5 once more simultaneously receive the equivalent of the driving pulses. At the end of 60 pulses, the counter 7 reaches 0 and changes over FF18 again, which stops the motor M, the seconds hand being again in the alarm position. The counter counts up 60 pulses to the state 63, so that the motor waits 60 seconds, then it overtakes and so on. Let us sum up by giving an example. With the first brief pressure on the button P, the motor M stops and waits until counter 5 reaches its maximum capacity 63 from 0; then it makes up a number of pulses, 20 for example, corresponding to the number of steps to be effected by the rapid advance of the motor in order for the seconds hand to reach the alarm position. During these 20 steps of the motor, the counter 5 counts down 20 pulses from state 63. At the same time, counter 7 counts up 20 pulses from a state which is determined by the time at which the button P has been actuated, until it reaches its state 0, and the motor again stops. The counter 5 receives 1 Hz pulses and counts up to 63, which means that the motor and consequently the hands of the timepiece are stopped for 20 seconds. Then the motor is returned to rapid advance operation and the counters 5 and 7 again receive the equivalent of the driving pulses. Counter 7 counts up until it again reaches its state 0, which means that it will now count 60 pulses because it starts from 0. Therefore, counter 5 counts down 60 pulses from state 63 to state 3. From now on, the motor stops 60 seconds, then makes up 60 seconds, and so on. It is to be seen that the initial delay is not made up; it varies between 3 seconds at the minimum, and 63 seconds at the maximum. Since the motor is continually coupled to the hands of the timepiece via the gear-train R, any stop or movement of the motor corresponds to a stop or a movement of the hands. With regard to the seconds hand, it is to be seen that one step of the motor corresponds to one step of this seconds hand, so that an advance of 60 steps of the motor corresponds to a whole turn of the seconds hand on the dial of the timepiece. It should also be noted that the up input of counter 5 continually receives the 1 Hz pulses delivered by the divider 2, because it is directly connected to the corresponding output of this divider. This means that during the visualization of the alarm, each second is counted by the counter 5, so that the device takes every loss of one second of time into account.

Let us now examine the case of the return to normal operation of the watch. A second brief pressure on the button P which closes the contact Cp changes over FF17 again, the Q output of which passes to zero. The gate 20 acts again as inverter, while FF10 is now in a state in which the alarm circuit 11 is blocked. The alarm device is out of action. If pressure is applied during a stopping phase of the motor M, the output which decodes the 0 state of the counter 5 is at 0. The output of the gate 20 passes to 1, as does the set input of FF18, the Q output of which passes to 1. This sets the motor M in rapid operation until the counter 5 drops back to 0 and effects the resetting of the FF18. The initial delay is now made up, since the state 0 of the counter 5 corresponds to the position of the seconds hand on the exact time, and since counter 5 continuously receives the 1 Hz signal on its up input. The system operates from then on as in the first phase where the motor advances step-by-step to the second. It is possible that at the moment of the second pressure on the button P, the watch is more than 60 seconds slow. In this case, during the making up, the counter 7 will deliver a brief pulse to the reset of FF18 before the counter 5 passes to 0, thus stopping the motor M. However, immediately after this pulse, since the counter 5 is still not at 0, it will impose a positioning signal again on FF18 through the gate 20 and the motor M will start again to operate. The disturbance cannot be seen, for the time constant C1R1 is clearly less than the period of the 32 Hz signal. If the pressure takes place during a making up period with rapid advance of the motor M, the motor M will advance to the state 0 of the counter 5 which will effect the resetting of FF18 and will return the system to normal operation. The above described disturbance will also pass unperceived. We have thus seen how to put the circuit into the alarm mode and how to visualise the alarm time.

Let us now examine the programming principle. During normal operation, we wait until the seconds hand becomes juxtaposed to the hour hand. At this moment continuous pressure is applied to the button P which closes the contact Cp. FF17 changes over, thus causing the motor M to stop, as well as putting into service the alarm and starting the make-up function as described above. When the counter 5 counts to 3, its output, which corresponds to this state, delivers a clock pulse to FF16 through the gate 14. The Q output of FF16, as it passes to 1 keeps FF17 in its state, effects the resetting of the counter 7, which is then blocked in state 0 and gives another short pulse to the reset input of the counter 6. The state 0 of this counter 6 then corresponds to the position of the seconds hand juxtaposed with the hours hand, which represents the reference time, i.e., the time at which the programming of alarm time takes place. From then on, if pressure is maintained on the button P, the output of the gate 15 is at 1, while the Q output of FF18 is at 0. The switch 3 is at normal advance and the output of gate 19 is at 0. The former 4 is unblocked, and the motor M advances with a frequency of 1 Hz while the counter 5 remains in its state, since it receives pulses simultaneously at its up and down clock inputs. If the button P is released, the output of the gate 19 passes to 1 and blocks the former 4. The motor M stops and the counter 5 accounts for the delay. If the pressure on P is maintained, the seconds hand will advance until it comes into a position which corresponds to the desired alarm time. Simultaneously, the counter 6 counts the steps of the motor M through the circuit 9.

In fact, each position of this hand, with reference to the hour scale, corresponds to one hour precisely. As the watch advances to the second, or 60 steps round the dial, these steps correspond to the minutes 12, 24, 36, 48 and 0 on the scale of the hours. If the seconds hand is stopped by releasing the button P, for example, in position 23 of the dial 23 this corresponds to the alarm time 4h 36. The counter 5 advances while the counter 6 receives no more pulses. Counter 6 has counted all the steps effected by the motor M between the position of the seconds hand juxtaposed with that of the hour hand, and the position of the seconds hand corresponding to the alarm time. Each of these step represents 12 minutes in actual time. When the counter 5 reaches 63, FF18 changes over, over and its output effects the resetting of FF16, the Q output of which passes to 0, unblocking the counter 7 which was kept at 0. The state 0 of counter 7 therefore corresponds to the position of the seconds hand on the dial representing the selected alarm time, relative to the hour scale. The motor M then advances at a rapid rate and the system operates by overtaking as we have described in the preceding phase. The counters 6 and 7 simultaneously receive the equivalent of the driving pulses, the first by means of the suppression circuit 9, the second directly from the former 4. It is to be seen that the content of counter 6 is greater than that of counter 7 by x steps, each representing 12 minutes, because of the previously programmed difference between the time when the seconds hand is juxtaposed with the hours hand, and the time of alarm.

If another brief pressure is applied to the button P, after the automatic registration of the alarm time in the passage of the counter 5 to state 63, FF17 changes state and the system returns to normal operation. Let us then return to the programming phase. As previously seen, the alarm time is programmed by the state 0 of counter 7 which corresponds to the alarm time as indicated by the seconds hand on the hours scale, and by the contents of counter 6 which corresponds to the difference between the alarm time and the time at which this alarm time is programmed (seconds hand juxtaposed with the hours hand). At the moment of the alarm time, both counters 6 and 7 must pass to state 0 simultaneously. When counters 6 and 7 simultaneously pass from 59 to 0, they deliver pulses through the capacitors C1 and C2 to the input of the AND gate 12, which in turn delivers a pulse to the clock input of FF10 for causing the emission of sound through the alarm circuit 11. For this to occur, it is only necessary for the counter 6 to lose its advance on the counter 7, which in turn remains synchronised with the position of the seconds hand. Each advance step of the counter 6 represents, as we have seen, 12 minutes of actual time. By skipping or suppressing one pulse on the clock input of this counter 6 every 12 minutes, the synchronous state of the counters 6 and 7 will be obtained at the end of x times 12 minutes, the difference between the actual time and the alarm time which has been programmed. The counter 8 receives a pulse every minute from the output of the counter 7, and divides the total number of pulses received by 12. Thus, the output of counter 8 delivers a pulse precisely every 12 minutes, which, by acting on the suppression circuit 9, makes it possible to skip or suppress delivery of a pulse to the clock input of the counter 6 as is necessary. At the selected alarm time, i.e., with the passage to 0 of the counters 6 and 7, the seconds hand is juxtaposed with the hour hand and the alarm device 11 energizes the sound emitter HP. The zero state of the counter 7 also corresponds to the stopping of the motor M, and since the system operates by overtaking, the seconds hand therefore remains in its position. From them on, by applying a brief pressure to the button P, the FF17 changes state again and its Q output passes to 1 which blocks FF10, thus interrupting the alarm signal. Simultaneously the motor M advances with rapid operation and overtakes the accumulated delay as described in the preceding phase. The counter 5 then returns to the state 0 and the watch passes to normal operation. The programming remains unchanged. The counters 6 and 7, synchronous at the moment of the alarm time, become desynchronised at the rate of one step every 12 minutes, so that at the end of 60 steps or $60 \times 12$ minutes $= 12$ hours, they will return into phase and will release the alarm for as long as the user has pressed the button P again to rearm the device.

To sum up, the counter 6 passes through 0 when the seconds hand, is superimposed on the hour hand and the counter 7 passes through 0 when the seconds hand passes over a position corresponding to the alarm time relative to the hours scale. When these two counters pass through 0 simultaneously, the actual time corresponds to the programmed alarm time. It is possible for the user to visualise this programmed alarm time as desired, the seconds hand becoming positioned on the position corresponding to the passage of the counter 7 to 0. Operation by overtaking permits this visualization without loss of time. On the other hand, operation by automatic overtaking (seconds hand blocked on the alarm time and overtaking every minute) clearly indicates to the user that the alarm device is engaged. It is certainly possible, by using a plurality of counters, to program a plurality of alarm times.

It is also possible to program and visualise, on demand, by an auxiliary system, other interesting parameters, for example, the date, the seconds hand, when controlled, coming into a position corresponding to the date, for example, to the 21st second for the 21st day of the month. It is also possible in this manner to suppress the mechanism of the date of the month usually employed and even to obtain a perpetual calender. Another interesting parameter to be programmed is the correction of an electronic trimmer.

Figure 3:
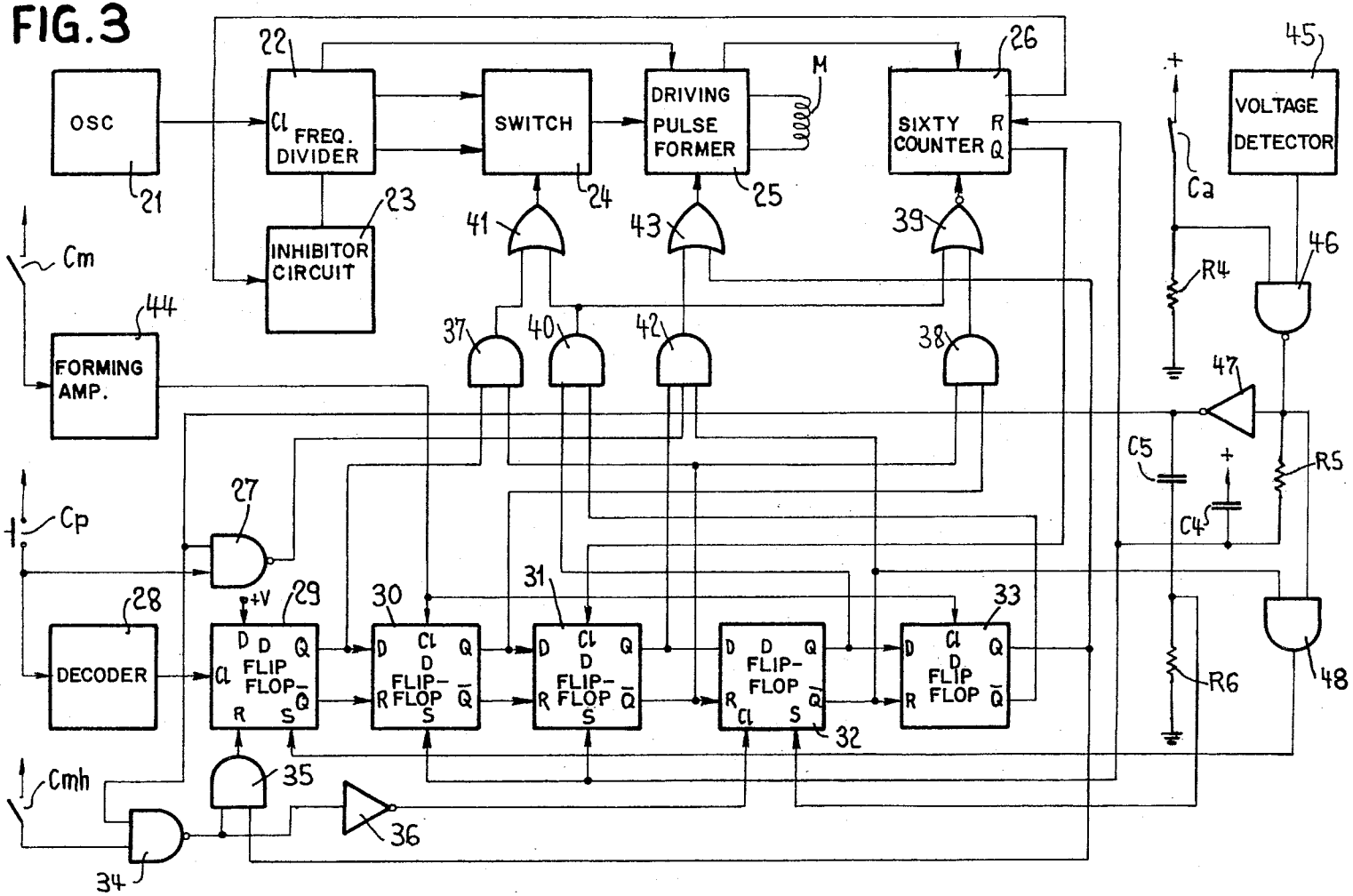
FIG. 3 is a block diagram of another embodiment of the circuit according to the present invention, making it possible to program an electronic trimmer for adjusting the frequency.

The diagram shown in FIG. 3 represents, by way of example, the circuit of a watch according to the invention making it possible to program an electronic circuit for adjusting the frequency of the divider. This circuit disposes of means making it possible to memorize the state of the trimmer by positioning the seconds hand on a corresponding position when the feed voltage disappears. It is, in fact, important for the user not to have to readjust his watch with each change of battery.

The oscillator 21 is connected to the input of the frequency divider 22, other inputs of which are connected to corresponding outputs of the adjustment circuit (inhibitor 23); outputs of the divider 22 are applied to inputs of the switch 24 and the driving pulse former 25. The output of the switch 24 is connected to another input of the former 26 which delivers driving pulses to the coil of the motor M and synchronous pulses to a sixty counter 26. This counter 26 delivers binary information to the adjustment circuit 23.

The contact Cp, actuated by the push button P, is connected to the first input of a NAND gate 27 and to the input of the decoder 28, the output of which is applied to the clock input of a D flip-flop 29, the D input of which is at +V. The Q and Q outputs of FF29 are connected respectively, to the D input and the reset input of a D flip-flop 30, the Q and Q outputs thereof being connected to the D input and to the reset input of a D flip-flop 31, the Q and Q outputs of which are connected to the D input and the reset input of a D flip-flop 32 and the Q and Q outputs FF32 are connected to the D input and the reset input of a D flip-flop 33. The contact, Cmh, actuated by the time setting shaft, is connected to the first input of a NAND gate 34, the output of which is connected to the first input of an AND gate 35 and to the input of the inverter 36, the output of which is connected to the clock input of FF32. The second input of the gate 35 is connected to the Q output of FF33 and its output to the reset input of FF29. The Q output of FF29 is also connected to an input of the AND gate 37, the second input of which is connected to the Q output of FF31 and to an input of the AND gate 38. The second input of this gate 38 is connected to the Q output of FF30 and its output to an input of a NOR gate 39, the output of which is connected to the enable input of the sixty counter 26. The Q output of FF32 is connected to an input of the AND gate 40, the second input of which is connected to the Q output of FF33. The output of the gate 40 is connected, on the one hand, to the second input of the gate 39, and on the other hand, to an input of an OR gate 41, the second input of which is connected to the output of the gate 37, and the output to the control input of the switch 24. The Q output of FF31 is connected to an input of the AND gate 42, a second input of which is connected to the output of the gate 27 and a third input to the Q output of FF32. The output of the gate 42 is connected to an input of the OR gate 43, the second input of which is connected to the Q output of FF33 and the output to the preparation input of the former 25.

The contact Cm, actuated by the gear-train and closing when the seconds hand passes through 0 is connected to the input of a forming amplifier 44, the output of which is connected to the clock inputs of FF30 and 33. The decoded output 0 of the counter by sixty 26 is connected to the clock input of FF31. The circuit comprises a static voltage detector 45 delivering a signal to an input of the NAND gate 46, the second input of which is connected to the contact Ca, connected to ground by the resistor R4. The output of the gate 46 is connected to the input of the inverter 47, to an input of the AND gate 48 and to a terminal of the resistor R5. The other terminal of this resistor is connected to the reset input of the counter 26, to the set inputs of FF30 and 31 and to the positive pole of the power supply via the capacitor C4. The output of the amplifier 47 is connected to inputs of the gates 27 and 34 and by the capacitor C5 to the set input of FF32 connected also to ground via the resistor R6. The second input of the gate 48 is connected to the Q output of FF32, and its output to the reset input of FF29.

Operation is as follows:

The oscillator 21 delivers a precise frequency to the divider 22 which delivers 1 Hz and 32 Hz signals to the inputs of the switch 24, and signals of 64 Hz to the former 25, determining the duration of the driving pulses. The switch 24 delivers signals of 1 Hz to the input of the former 25 when its controlled input is at 0 (normal operation) and 32 Hz when it is at 1 (rapid operation). The former 25 delivers clock pulses to the input of the counter 26 and bipolar driving pulses of the same frequency, to the coil of the motor M when its enable input is at 0. The counter by sixty 26 operates in binary manner and is arranged as a down counter. It thus passes from 0 (000000) to 59 (111011) then 58, 57 and so on. The binary outputs of the counter 26 are applied to the adjustment circuit 23 which acts on the divider 22 as a function of the state of the counter 26.

Normal operation

In normal operation Ca is closed, Cp and Cmh are open and the voltage detector 45 delivers a positive voltage. The output of the gate 46 is then at 0 and thus, so is the output of the gate 48. The set inputs of flip-flops FF29 to FF32 and the reset input of the counter 26 are at 0. The flip-flops FF29 to FF33 are at 0. The outputs of gates 37, 38, 40 and 42 are therefore at 0, as are the outputs of the gates 41 and 43. The output of the gate 39 is at 1. The switch 24 is then in normal operation, the former 25 is unblocked and the counter 26 is blocked in any state, for example 25. The motor advances normally at one step per second. The adjustment circuit 23 is arranged for example for correcting in steps of a value from +0.1 seconds per day ($1.16\times10^{-6}$ days). As the counter 26 is at the state 25, the adjustment circuit (electronic trimmer) corrects from +2.5 seconds per day.

Visualisation of the trimmer position

When the user wishes to know the position of the trimmer, he introduces, by means of the button P, in closing the contact Cp, a pre-determined code. This code should be sufficiently complicated for the user not to be able to introduce it by mistake (for example several presses in succession when the motor is on second pairs). This code appears at the output of the decoder 28 which identifies it and then delivers a positive pulse to the clock input of FF29 which passes to 1. The outputs of the gates 37 and 41 pass to 1 and the switch 24 passes to rapid advance. The motor M advances with rapid speed. The D input of FF30 has passed to 1 and its reset input to 0. When the seconds hand passes through 0 the output of the amplifier 44 delivers a clock pulse to the input of FF30 which passes to 1. The output of the gate 38 passes to 1 and the output of the gate 39 to 0. The counter 26 will then countdown one step each time the motor M, still with rapid advance, advances by one step.

The D input of FF31 has passed to 1 and its reset input to 0. At the end of 25 motor steps, the counter 26 passes to 0 and delivers a clock pulse to the input of FF31 which passes to 1. The seconds hand is then on 25 seconds since the motor has advanced by 25 steps (state of counter 26) since it has passed position 0. When FF31 passes to 1, the output of the gate 42 passes to 1 and thus the output of the gate 43 which controls the enable input of the former 25. The motor receives no more pulses and the seconds hand remains blocked on the 25th second. The Q output of FF31 has passed to 0 and thus the outputs of the gates 37 and 38. The output of the gate 41 returns to 0, thus bringing the switch 24 to normal advance, whilst the output of the gate 39 passes to 1, thus blocking the counter 26 at 0. The seconds hand then definitely indicates the content of the trimmer, i.e. +25 steps.

Modification of the programming

If the user wishes to modify the programming of the trimmer, he then presses on P closing the contact Cp. The output of the gate 27 passes to 0 as does the output of the gate 42 and the output of the gate 43. The enable input of the former 25 is then at 0 during the exertion of pressure, thus making it possible to advance the motor and displace the seconds hand. The output of the gate 39 itself has remained at 1 and the counter 26 rests at 0, its enable input being energised. Let us assume that the user wishes the trimmer to correct by +3.5 seconds per day. He will then bring the seconds hand to the position +35 seconds by pressing on P, then release P. The needle remains in this position.

Registration of the programmed value

In order to register this new value, the user pulls the time setting shaft MH, which closes the contact Cmh. The output of the gate 34 passes to 0 and that of the invertor 36 to 1. FF32 receives a clock pulse and passes to 1. The output of the gate 40 passes to 1 as does the output of the gate 41, whilst the output of the gate 39 passes to 0. The switch 24 then passes to rapid advance again, whilst the enable input of the counter 26 is unblocked. Simultaneously the Q output of FF32 has passed to 0 and thus the outputs of the gates 42 and 43, unblocking the enable input of the former 25. The counter then starts to advance rapidly, the counter 26, starting from 0, downcounting for each motor step. The D input and reset input of FF33 are respectively at 1 and 0. As soon as the seconds hand passes through the position 0, Cm closes and the amplifier 44 delivers a clock pulse to FF33 which changes its state to 1. The output of the gate 43 passes to 1, thus engaging the enable input of the former 25. The motor M receives no further pulses and the seconds hand is blocked at 0. The counter 26 has then counted down from 60 to 35 driving pulses. As it counts down, it is in the state 60−(60−35)=35. It has therefore registered the new value corresponding to the position of the seconds hand at the moment of registration, or rather corresponding to the number of motor steps separating the fixed position 0, detected by means of a contact Cm, from the position in which the user has placed the hand, in the particular case 35. The Q output of FF33 has swung to 0, the same as the outputs of the gates 40 and 41, the output of the gate 39 itself passing to 1. The switch 24 is again in the normal advance position and the the counter 26 is enabled. The state 35 is thus memorized and the adjustment circuit corrects the frequency of the divider by +3.5 seconds per day. The seconds hand remains blocked on 0 until the moment the user pushes back MH, which opens Cmh. The output of the gate 34 passes to 1 as does that of the gate 35 which controls the resetting of FF29 which then switches over to 0. Its Q output passes to 1 and acts on the reset input of FF30 which in turn passes to 0 and in turn sets FF31 to 0 etc. The whole flip-flop chain from 29 to 33 then returns to 0. When FF33 passes to 0, the output of the gate 35 passes to 0, thus suppressing the return to zero on FF29. Hence the chain is under the same conditions as at the start and the motor resumes normal operation. However, the state of the counter 26 has passed from 25 to 35, in accordance with the desire of the user.

Mechanical memorizing

This double operation consists in fact in transferring information from an electronic memory (counter 26) to a mechanical memory (position of the seconds hand) and vice versa. However, it is known that the counter 26 cannot store information in the absence of a feed voltage. On the other hand, the position of the seconds hand may be indefinitely retained without a supply of energy for as long as the motor has sufficient magnetic positioning.

Hence, in order to retain information, it is only necessary to transfer the information of the counter 26 in a mechanical form as soon as the feed voltage falls below a certain value or when the user is ready to remove the battery.

Let us see what happens when the voltage of the battery drops. The output of the detector 45 passes to 0 and the output of the gate 46 to 1. The output of the amplifier 47 passes to 0, thus imposing a state 1 on the outputs of the gates 27 and 34, thus making the contacts Cp and Cmh inoperative. If the Q output of FF32 is at 1, or as soon as it passes to 1, the output of the gate 48 passes to 1 and changes FF29 to 1. The visualisation cycle begins, the seconds hand starts with rapid advance until the moment when FF30 and FF31 have passed in succession to 1 and it is blocked on the position corresponding to the state of the information memorised previously by the counter 26. No manipulation of the controls from now on will be able to cause it to leave this position whilst the feed voltage has not risen above the predetermined value. When the output of 46 has passed to 1, the capacitor C4 discharges through the resistor R5. The time constant C4R5 being several seconds, the set inputs of FF30 and 31, as well as the return to zero of the counter 36 pass to 1 only after the preceding operation is concluded. However, the capacitor C4 is still useful. If the voltage disappears completely, then suddenly reappears, the states of FF29 to 33 may be as desired. Nevertheless, the capacitor C4 being discharged and being connected to the positive pole, it will immediately impose a 1 on the set inputs of FF30 and 31 and on the return to zero of the counter 26, putting these components into the correct state.

Let us see what happens when the voltage of the battery rises above the detection value. The output of 45 passes to 1, the output of 46 to 0 and the output of 47 to 1. This positive edge is derived through the capacitor C5 and the resistor R6. A fine pulse appears at the set input of FF32 which passes to 1, thus causing registration of the information in the counter 26. The seconds hand passes rapidly to 0 and FF33 passes to 1. If the contact Cmh closes, the hand remains blocked on 0. On the other hand, if the contact is open, the output of the gate 35 passes to 1, operating the resetting of the flip-flop chain FF29 to FF33 and the hand continues with normal operation.

The contact Ca acts in the same manner as the detector 45. This contact serves as it were to warn the circuit that the user is soon going to remove the battery. This contact is therefore integral with a part that the user must necessarily remove before the battery flange. Hence, the circuit disposes, before the disappearance of the feed voltage, of the time necessary for the operation of the memory mechanism. When the user puts another battery in position, he must first return the battery flange to its position, thus feeding the circuit. The watch will resume operation again only when the user has returned this part to its position and thus closed the contact Ga again, registration being effected as soon as this contact is closed.

It is quite clear that the diagrams shown in FIGS. 2 and 3 are given only as examples. It is obviously possible to use many other control sequences, as well as arrangements comprising several counters of driving pulses, arrangements comprising memories in which the state of these counters is transferred at certain moments, and even arithmetic circuits making it possible to add or subract the states of these memories and counters for obtaining the information applied to the inputs of the circuit for carrying out an auxiliary function.

Figure 4:
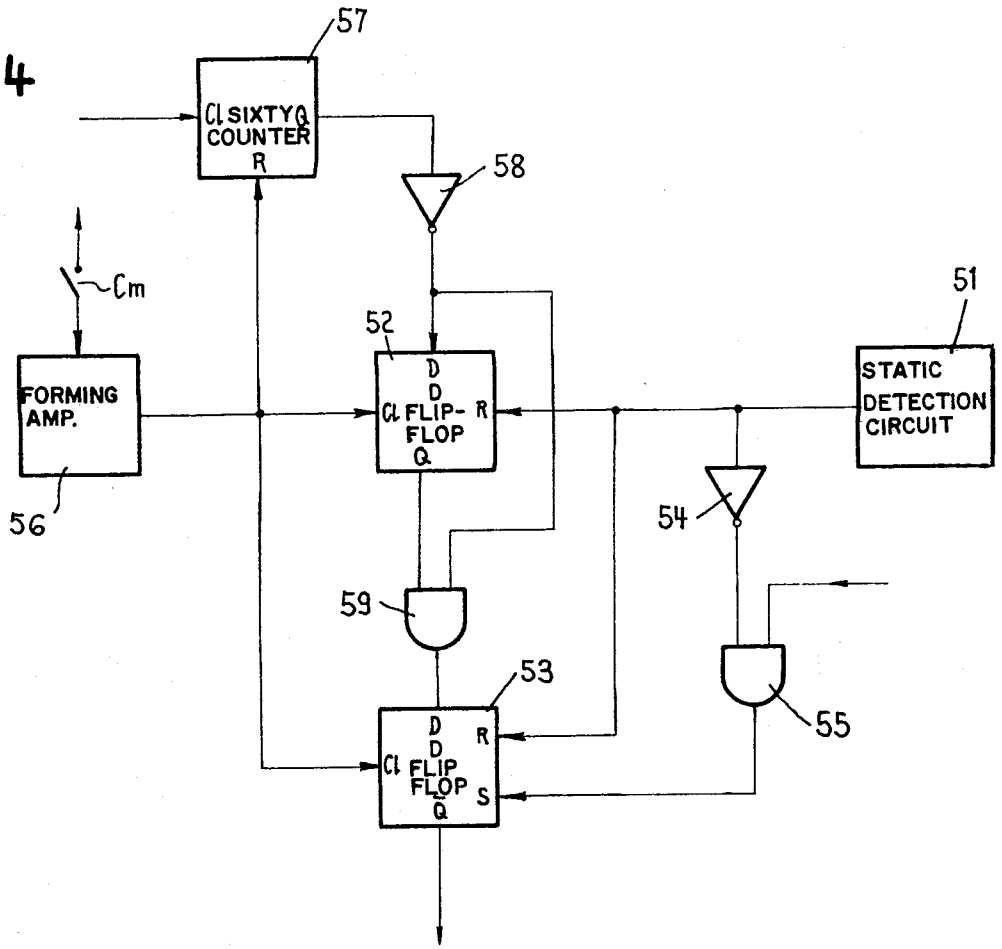
FIG. 4 is a block diagram of the detector of feed voltage insufficiency used in FIG. 3, according to the invention.

In the same manner, the voltage detection circuit may be obtained in different forms. The simplest circuit consists in using a voltage reference element and a circuit for comparing the feed source voltage and this reference. We shall call this type of circuit a "static detection circuit". Another process consists in detecting the voltage value, independent of a reference voltage, for which good operation of the motor is no longer assured. This value is in general lower than the detection level of the static circuit which is adjusted to a value in which good operation of the motor can be guaranteed. For example, for a nominal voltage of the electric source of 1.58 V, the static detection circuit level will be adjusted at 1.4 V, whilst the motor still operates up to 1.2 V. The circuit shown in FIG. 4 shows by way of example a feed voltage insufficiency detector, such as may be used in the circuit shown in FIG. 3, by using a combination of these two systems.

This circuit comprises a static detection circuit 51, delivering a positive polarity signal when the feed voltage is greater than the reference voltage. The output of circuit 51 is connected to the reset inputs of D flip-flops 52 and 53 and to the input of an invertor 54, the output of which is connected to the first input of an AND gate 55. The second input of this AND gate 55 is connected to the preparation input of the former 4 or 25 in FIG. 2 or 3, and its output to the set input of of FF53. The contact Cm, closing when the seconds hand passes to 0, is connected to the input of the forming amplifier 56 delivering pulses to its output. This output is connected to the clock inputs of FF52 and FF53 and to the return to zero input of a sixty counter 57 the input of which receives pulses synchronised with the driving pulses, and the output of which is connected to the D input of FF52 and to the first input of the AND gate 59. The second input of this gate 59 is connected to the Q output of FF52 whilst its output is connected to the D input of FF53.

Operation is as follows:

When the battery voltage is greater than the detection level of the circuit 51, the output thereof is at 1. The Q outputs of FF52 and FF53 are at 0. When the feed voltage becomes less than this level, the output of the circuit 51 passes to 0. The output of the invertor 54 is at 1 and the output of the gate 55 remains at 0, as long as the preparation input of the former is at 0. The motor then advances and the counter 57 counts the driving pulses. When the seconds hand passes through 0, the amplifier 56 delivers a clock pulse to FF52 and FF53. If the counter 57 is not at 0, the output of the invertor 58 is at 1, FF52 then passes to 1. As the output of FF52 was previously at 0, the output of the gate 59 was at 0 and FF53 remains at 0. The counter 57 is simultaneously returned to 0.

After 60 driving pulses the counter 57 is at 0. Its output is then at 1. The output of invertor 58 is at 0 and the output of gate 59 also. If the motor has operated normally, the seconds hand should have advanced by 60 steps and should then arrive at 0 again. The output of 56 delivers another pulse which changes FF52 to 0, FF53 remaining at 0. If, on the other hand, the motor has not operated normally, the seconds hand will arrive at 0, whilst the counter 57 is no longer at 0. Its output is then 0. The outputs of invertor 58 and gate 59 are at 1. FF53 goes to 1, whilst FF52 has remained at 1.

The output of the circuit (Q of FF53) will therefore pass to 0 when the output of the counter 57 is twice desynchronised in succession relative to the contact Cm. This condition occurs only if the motor has repeated breakdowns, that is to say when the feed voltage is insufficient to ensure good operation of the motor.

This system, which we shall call "dynamic", therefore makes it possible to ensure normal operation of the watch to the limit of operation of the motor. Obviously it can operate only if the motor advances, that is to say if the enable input is at 0. If the latter is at 1, the output of the gate 55 passes to 1, as soon as the output of the detector 51 passes to 0. FF53 then passes immediately to 1, without taking into account the synchronism between the contacts Cm and the counter 57. Another solution consists in suppressing the enable function and then setting the motor in operation again as soon as the output of the detector 51 passes to 0. For this it is necessary to start the motor again whatever the position of the control and time setting means may be, i.e., these means should not comprise any mechanical system for blocking the wheel mechanism for example, a second stop.

Figure 5:
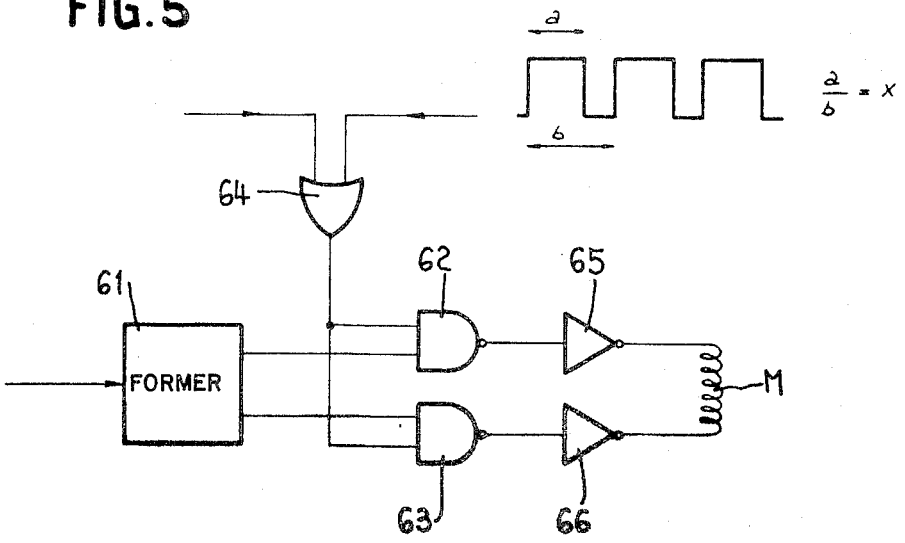
FIG. 5 is a block diagram of a circuit for use in the network of FIG. 3 according to the invention, making it possible to chip high frequency driving pulses in a variable ratio.

The use of such a system may pose certain risks. In fact, as the moment is detected in which the voltage is insufficient to ensure operation of the motor, one may wonder if it will receive sufficient energy to position the seconds hand in the right place. This problem may be solved simply by arranging the driving pulse former in such manner that it can, when switching it at the moment when the circuit for detecting voltage insufficiency disengages, deliver energy pulses greater than the normal, for example, pulses of longer duration. Another means is shown by the circuit in FIG. 5. This means consists in chopping at high frequency the driving pulses in a variable ratio.

The former 61 delivers alternate positive pulses to the first inputs of NAND gates 62 and 63, the second inputs of which are connected to the output of an OR gate 64. One input of this OR gate 64 is supplied with a train of rectangular high frequency pulses the ratio between the positive phase and the period being equal to x. The other input of this OR gate 64 is connected to the switching signal. The output of the gate 62 is connected to the input of an inverter amplifier 65, the output of which is connected to a terminal of the coil of the motor M. The output of the gate 63 is connected to the input of an invertor amplifier 66, the output of which is connected to the other terminal of the coil of the motor M.

When the switching signal is at 0 (normal), the train of rectangular waves appears on the inputs of 62 and 63 and chops the driving pulses. The average voltage of these pulses is reduced in the ratio x. It is well known that present day watch motors have a high series self-inductance. This self-inductance functions as a current integrator, that is to say, as an auto transformer and everything proceeds as if the motor was in fact being fed by the voltage pulses xV.

When the switching signal is at 1 (greater energy), the output of the OR gate 64 is at 1 and the motor receives pulses that have not been chopped, that is to say of voltage V.

If the motor is calculated to function normally with pulses of value xV, it is then possible, at the moment the circuit detects a feed voltage insufficiency, to give it an excess of energy and couple making it possible to ensure at least its positioning in the position corresponding to the content of trimmer information.

Another interesting circuit is a decoder as may be used in FIG. 3. This decoder should be sufficiently reliable for the user not to let off it in error or inadvertently, and sufficiently simple so that it does not demand a particular skill from him. An interesting solution is a decoder synchronous with the seconds hand.

Figure 6:
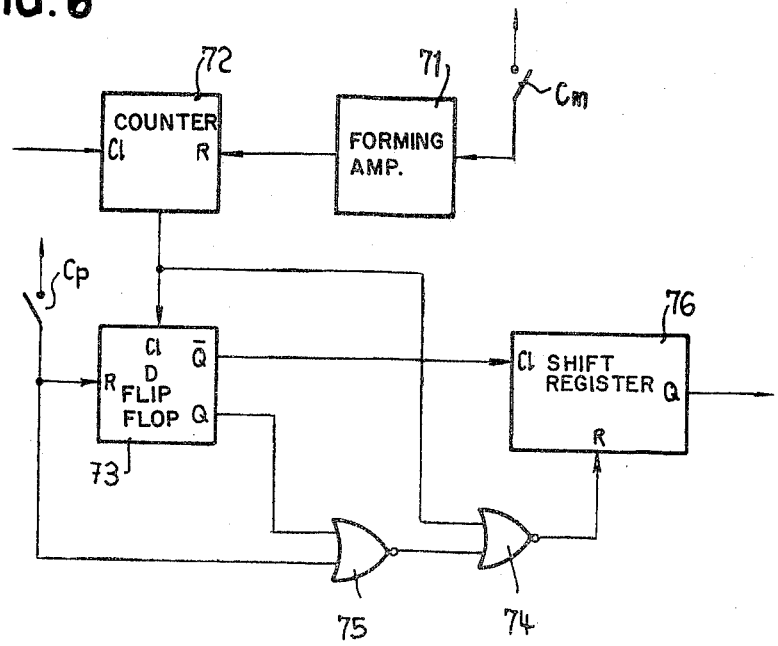
FIG. 6 is a block diagram of a decoder synchronised with the seconds for use in the network of FIG. 3, according to the invention.

The diagram shown in FIG. 6 represents, by way of example, such a decoder. The minute contact Cm is connected to the input of the forming amplifier 71 which delivers reset pulses, when the seconds hand passes through 0, to the divide by 4 counter 72 which receives clock pulses synchronous with the driving pulses. This counter 72 has a decoded output of state 00 which then passes to 1 when the hand is on the seconds 0, 4, 8, 12, etc. This output is connected to the clock input of a D flip-flop 73, and to an input of a NOR gate 74. The contact Cp connected to the push button P is attached to the reset input of FF73 and to an input of a NOR gate 75, the second input of which is connected to the Q output of FF73 and the output to the second input of the gate 74. The Q output of FF73 is connected to the clock input of a shift register having three stages, 76, the return to zero input of which is connected to the output of the gate 74. The Q output of the third stage of the register 76 is the output of the decoder.

Operation is as follows:

When the counter 72 arrives at 0, for example, when the seconds hand reaches a position 0, its output passes to 1 and FF73 goes to 1. If the user presses Cp during this time interval, FF73 returns to 0, its Q output passes to 1. The output of the gate 74 is at 0, so that the first stage of the register 76 passes to 1. When the seconds hand reaches position 4, the counter 72 passes to position 0 and switches FF73 to 1. Pressure on Cp switches FF73 to 0 and switches the second stage of the register 76 to 1. When the seconds hand reaches position 8, the counter 72 passes to 0, FF73 switches. If the user presses on Cp, FF73 returns to 0 and gives a clock pulse to the third stage of the register 76 which passes to 1 and controls visualisation. In order to disengage the latter, it is therefore necessary to press three times in succession when the seconds hand is in one of the positions 0, 4, 8, 12 seconds etc.

Let us see what happens if the user presses at another moment, for example, on the second 3. The output of the counter 72 is then at 0. By pressing Cp, the output of the gate 75 passes to 0. As both inputs of the gate 74 are at 1, its output passes to 1 and effects the return to zero of the register 76. It is then necessary to begin the operation again.

Let us see what happens, if for example, the user has pressed correctly twice in succession and forgets to press the third time. The first and second states of the register 76 are at 1. When the counter 72 reaches 0 again, its output passes to 1 and FF73 passes to 1. The user forgets to press Cp. When the counter 72 passes to 1, its output passes to 0, whilst FF73 has not been returned to zero and is therefore still at 1. The output of the gate 75 is therefore at 0. Both inputs of the gate 74 being at 0, its output passes to 1 and the register 76 is returned to 0.

It may therefore be stated that any incorrect pressure and any omission of pressure of Cp involves the return of 0 of the register. The operation should therefore be restarted. Despite the simplicity of the code, it may be admitted that it is sufficient to protect the user from any ill timed manipulation.

What we claim is:

1. An electronic timepiece comprising:

a power source;

means for producing time base pulses of a first frequency;

time display hands including a seconds hand;

means connected to said power source for driving said time display hands in response to said time pulses for indicating the actual time;

means responsive to said time base pulses for producing an actual time data signal;

manually actuatable means for producing a data signal;

means for performing an auxiliary function in response to said data signal;

means for storing said data signal;

means for producing on and off control signals; and control means having means responsive to said on control signal for coupling said stored data signal with said driving means for causing said driving means to drive said seconds hand to an indicating position corresponding to said stored data signal, said control means further having means responsive to said off control signal for uncoupling said stored data signal and for applying pulses to said means until said time display hands indicate the actual time.

2. The electronic timepiece of claim 1, wherein said storing means includes manually actuatable means for producing a setting signal and manually actuatable means for producing a storing control signal;

said control means further including means responsive to said setting signal for causing said driving means to drive said seconds hand to a desired position and means responsive to said storing control signal for causing the storage of said data signal corresponding to said desired position.

3. The electronic timepiece of claim 2, wherein said means for producing on and off control signals is manually operable.

4. The electronic timepiece of claim 1, wherein said control means further comprises means for causing said driving means to drive said seconds hand alternatively to said indicating position and to a position corresponding to said actual time data signal.

5. The electronic timepiece of claim 3, wherein said means for performing an auxiliary function includes means for producing a comparison signal when said actual time data signal is identical to said stored data signal and means responsive to said comparison signal for producing an alarm signal.

6. The electronic timepiece of claim 1, wherein said time base pulses producing means includes means for producing a high frequency signal and means for dividing by a dividing ratio the frequency of said high frequency signal, said means for performing said auxiliary function having adjusting means connected to frequency dividing means for adjusting said dividing ratio in response to said stored data signal.

7. The electronic timepiece of claim 6, wherein said means for performing an auxiliary function includes means for producing a voltage level detection signal in response to the voltage level of said power source, said means for producing said on and off control signals being responsive to said voltage level detection signal.

8. The electronic timepiece of claim 6, wherein said means for producing on and off control signals is manually operable.

9. The electronic timepiece of claim 6, further comprising means coupled to said power source for producing a power source removing signal prior to the removing of said power source and a power source mounting signal after the mounting of said power source, said control means including means responsive to said power source removing signal for causing said motor to drive said seconds hand to said indicating position, said control means further including means responsive to said power source mounting signal for producing a data signal corresponding to said indicating position of said seconds hand and for causing said storing means to store said data signal.

10. The electronic timepiece of claim 7, further comprising means for producing drive pulses with a power level in response to said time base pulses and means for controlling the power level of said drive pulses in response to said voltage level detection signal, wherein said driving means includes a stepping motor responsive to said drive pulses for driving said seconds hand.

11. The electronic timepiece of claim 10, wherein said power level controlling means includes means for producing rectangular pulses of a second frequency higher than said first frequency, and means for combining said rectangular pulses and said drive pulses in response to said voltage level detection signal.

* * * * *